US007011097B2

(12) United States Patent
Srivastava

(10) Patent No.: US 7,011,097 B2
(45) Date of Patent: Mar. 14, 2006

(54) BRAIDER

(75) Inventor: Priti Srivastava, White Plains, NY (US)

(73) Assignee: Each2Each, Inc., White Plains, NY (US)

( * ) Notice: Subject to any disclaimer, the term of this patent is extended or adjusted under 35 U.S.C. 154(b) by 0 days.

(21) Appl. No.: 10/127,629

(22) Filed: Apr. 22, 2002

(65) Prior Publication Data

US 2003/0188759 A1 Oct. 9, 2003

Related U.S. Application Data

(60) Provisional application No. 60/370,654, filed on Apr. 8, 2002.

(51) Int. Cl.
*A45D 24/00* (2006.01)

(52) U.S. Cl. ..... 132/200

(58) Field of Classification Search ..... 132/210, 132/212, 226, 273, 207, 276, 280, 284, 245, 132/238, 237, 200; 24/30.5 S
See application file for complete search history.

(56) References Cited

U.S. PATENT DOCUMENTS 1,774,390 A * 8/1930 McGrath ..... 132/245
2,430,766 A * 11/1947 Gregory ..... 132/245
2,590,166 A * 3/1952 Farrell ..... 132/207
2,669,239 A * 2/1954 Smith ..... 132/207
2,844,154 A * 7/1958 Solomon ..... 132/245
3,930,511 A 1/1976 Roney
4,509,231 A * 4/1985 Paxton ..... 24/30.5 R
4,760,624 A * 8/1988 Fish ..... 24/30.5 S
5,311,646 A * 5/1994 Eischen, Sr. ..... 24/30.5 S
5,518,011 A 5/1996 Nash
5,544,666 A 8/1996 Schach
D373,654 S 9/1996 Schach
5,564,445 A 10/1996 Query
5,575,297 A 11/1996 Hatchett
5,810,023 A * 9/1998 Jones et al. ..... 132/207
5,819,761 A * 10/1998 Sloan ..... 132/210
6,164,289 A 12/2000 Ogunro
6,427,701 B1 * 8/2002 Roth ..... 132/245

* cited by examiner

*Primary Examiner*—John J. Wilson
*Assistant Examiner*—Robyn Doan
(74) *Attorney, Agent, or Firm*—Lackenbach Siegel, LLP

(57) ABSTRACT

A novel form of a braider is provided which, in its preferred embodiment, consists of a body portion with two opposing cavities. The cavities are designed so as to enable both easy insertion into and removal from of sections of hair from the cavities. Several novel methods for using the braider are also provided. In one use, the wearer places each of two sections of her hair each within a cavity of the braider. She then repeatedly and alternately transfers sub-sections of hair from one cavity to the other thus creating a herringbone braid.

5 Claims, 7 Drawing Sheets

BRAIDER

CROSS-REFERENCE TO RELATED APPLICATIONS

This application is filed under 35 CFR 1.114 and claims priority from U.S. patent application Ser. No. 10/127,629, based in turn and claiming priority from U.S. Provisional App. Ser. No. 60/370,654, filed Apr. 8, 2002, the contents of which are incorporated herein by reference.

BACKGROUND OF THE INVENTION

This invention relates to an improved braiding device particularly one that can be used to create a style of braids called herringbone or fishbone braids. While the braider of this invention has been designed specifically to create herringbone braids, it is also adaptable to several other styles of braids. The braider of this invention has several advantages over existing prior art devices that are described in the following paragraphs.

In U.S. Pat. No. 5,518,011 inventor Nash describes a device that can be used to weave hair. This device comprises an elongated handle member which terminates in a comb base. A plurality of spaced fingers or tines extend from the comb base in substantially parallel relation to one another to define a series of hair receiving slots. Hair is woven through the series of slots in a predetermined sequence to form a braid. Nash's device, sold under the tradename Wonder Weave(R), is meant mainly for the conventional 3-strand braids. Also, Nash's device is hard to use because there are multiple slots to receive hair; thus it is hard for a user to keep track of which slot to use for which strands of hair. The problem of trying to determine which slot to use for which strand of hair is especially pronounced when a user is trying to braid her own hair at the back of her head.

U.S. Pat. No. 5,575,297 by Hatchett et al describes a device consisting of a plurality of adjacent elongated rigid members joined to and arising in a perpendicular manner in such a way that slots are formed between the adjacent elongated members to retain sections of hair. Hatchett's device, like Nash's, is intended for standard 3-strand braids. Hatchett's device, sold under the tradename Easy Braid®, is hard to manufacture because of the use of a rigid body portion with flexible foam components. Additionally, Hatchett's device has the same shortcomings as Nash's device mentioned in the preceding paragraph: because of the presence of multiple slots, it is difficult for a user to determine which slot to use for which strand of hair.

In U.S. Pat. No. 5,544,666, Schach describes a braiding device that can be used for making braids. Schach's device, sold under the tradename Braidini®, includes a plurality of apertures formed in a serpentine shaped extension. Schach's device is likely to intimidate the average consumer because of its complex design. Schach's device is also hard to use for the same reason as the devices described by Nash and Hatchett: there are multiple openings for receiving strands of hair making it difficult for a user to figure out which aperture to use for which strands of hair.

In patent DE 3008162 inventor Schmehling provides a device for securely attaching a hairpiece or a wig to the remaining hair on a wearer's head. Some of the embodiments of Schmehling's device consist of two opposing cavities. However the cavities of that device have been shaped to optimally prevent hair from escaping easily from them since the idea is to secure the device immovably. This would make the device inappropriate for making herringbone braids since such braids require repeated removal of strands of hair from cavities as well as repeated insertion of hair into cavities. Additionally, Schmehling's device has several notched areas, again for securely fastening a wig. These notches would snag hair and interfere with the braiding process. Finally, Schmehling's device has been designed specifically for affixing wigs and not for braiding.

In U.S. Pat. No. 2,655,926 Parrilla describes a Hair Curler that has an elongate structure with hair receiving slots at opposite ends. However, Parrilla's device differs significantly from the device of this invention. Parrilla's device is intended for curling hair and is therefore restricted to being cylindrical in shape. The two ends of Parrilla's device are necessarily asymmetrical in order to provide the user with two different curling diameters. The two slots of Parrilla's device are used only one at a time depending on the size of the curl desired by the user. In contrast, the two cavity-containing ends of the device of the current invention are necessarily symmetric. Parrilla's device is relatively expensive to make because it is constructed of multiple components. The spring blade that forms the flexible hair-retaining element has to be assembled separately from the process of forming the main body of the curler. In contrast, the device of the current invention does not require assembling. Parrilla's device requires that at least one surface of each slot be flat so that the spring blade element can press against it. In fact, Parrilla's device has been designed primarily for retention of hair. Such a design would be a hindrance in the creation of herringbone braids since hair strands have to be repeatedly removed as well as inserted into the cavities during the braiding process. Any design that focuses primarily on the retention of hair inside a cavity would not work well for the purpose of creating a herringbone braid.

In U.S. Pat. No. 5,819,761 Sloan describes a hair braiding device that consists of a flat elongate body having at least one opposing pair of slotted openings with the openings being lined with a resilient material that permits hair strands to be introduced thereinto and that allows the device to be rotated to create a rope braid. Like the device by Parrilla, Sloan's invention is primarily intended to retain hair within the cavities and prevent strands from escaping during the twisting process. Sloan's device requires an opposing yieldable lining that will grab on to hair strands when the device is being rotated. In fact, Sloan's device has been especially designed with rotation in mind. It requires that hair strands not escape from the openings during rotation. The use of tillable lining in Sloan's device is, in fact, intended to prevent hair strands from being easily removed. Thus Sloan's intention is quite contrary to the device of the current invention. The braider of this invention requires that the cavities allow repeated removal from the cavities as well as insertion into the cavities of hair strands for the purpose of braiding. The use of lining inside the cavities of Sloan's device is likely to snag hair and prevent a smooth creation of herringbone braids. This makes Sloan's device less than ideal for braids such as the herringbone that require that sections of hair be removed often from the openings during the braiding process. Sloan's device is also hard and expensive to manufacture because it includes a lining attached on the inside of each of the slots. Additionally, the method taught by Sloan is restricted to a single style of braid, the rope braid.

Thus, it is the object of this invention to provide a braider that has a user-friendly design and operation. This is in contrast to many prior art devices that are likely to intimidate the user with their complicated appearance.

Additionally, it is the object of this invention to provide a hair braiding device that can be used to create many different styles of braids including herringbone braids, rope braids, chevron braids, diagonal braids, twisted braids, coil braids and many others.

It is a further object of this invention to provide a braiding device that is very inexpensive and easy to manufacture.

Another object of this invention is to provide a device that will allow the user to interrupt the braiding process temporarily if needed without worrying about the braid unraveling during the interruption.

A still further object of this invention is to provide a compact device that can easily be packed for travel. The braider can also be provided with its own hanger hole so as to allow for low packaging costs for commerce.

A still further object of this invention is to provide several methods for making a variety of braids using the braider of this invention.

Yet another object of this invention is to provide an aesthetic hair accessory that can be used to create non-braided hair styles.

Other and still further objects, features and advantages of the braider will become obvious from a reading of the following detailed description of the present invention, taken in conjunction with the accompanying drawings.

BRIEF SUMMARY OF THE INVENTION

The present invention provides a braider that can be used to make many different styles of braids very easily. Methods for making such braids with the aid of the braider are also provided.

The design of the current invention presents several advantages.

The simple design of the braider allows for easy manufacturing and translates to lower costs for the consumer. It can be made inexpensively from a wide variety of materials including but not limited to polymers, wire, cardboard, metal, piping, flexible clay, foam rubber and various composites.

The simple design of the braider has an additional advantage: unlike many prior art devices it does not intimidate the user. The complicated user instructions and complex appearance of many prior art devices made them unappealing to the user. In contrast, the braider of this invention is very simple in design.

The braider of this invention is also very easy to use. Even very young users will have little trouble mastering the many different hair styles that can be created with the braider of this invention.

The braider is very compact and can be easily carried in a purse without adding either bulk or weight. It can easily be packed for travel.

The braider is a great gift item for anyone with medium to long hair.

The braider will also make a great toy item allowing little girls to braid the hair on their dolls.

Thus the braider of this invention has great potential for market success. It is highly versatile; it is inexpensive to manufacture; it can be offered to the consumer at an easily affordable price; it is both a tool and an accessory; additionally, it is a brand new item in a market that is very receptive to innovative new products.

BRIEF DESCRIPTION OF THE DRAWINGS

FIG. 12 shows the first step of the braiding process.

FIG. 13 shows the second and third steps of the braiding process.

FIG. 14 shows a basic herringbone braid.

REFERENCE NUMERALS IN DRAWINGS

Figure 1:
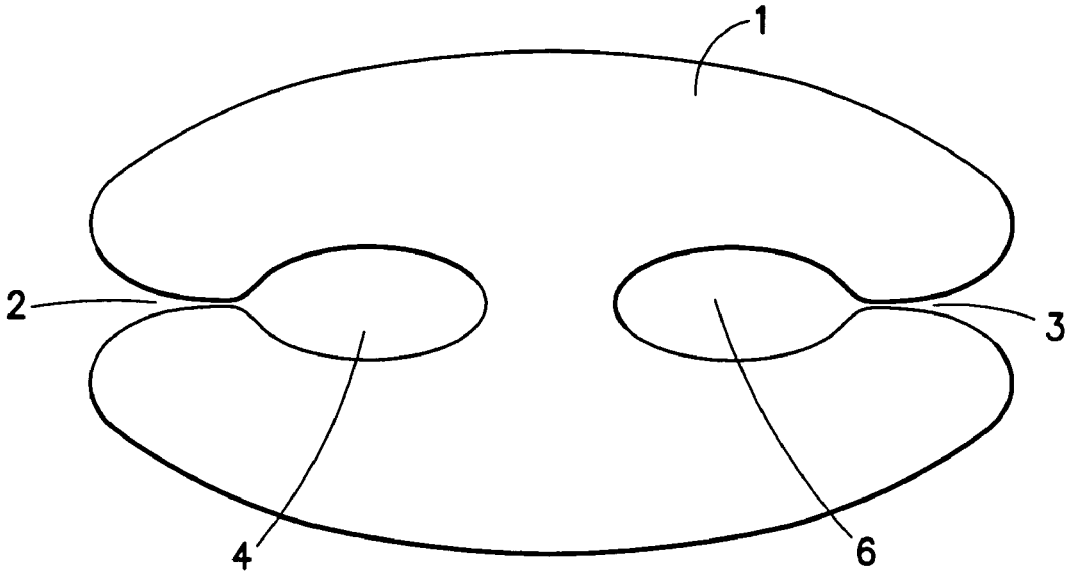
FIG. 1 shows a top elevational view of the first embodiment of the braider of this invention. The bottom plan view of the braider is a mirror image and is, therefore, not shown.

1 first embodiment of the braider of this invention
2 mouth portion of first cavity
3 mouth portion of second cavity
4 first cavity of the braider
6 second cavity of the braider
12 a second embodiment of the braider of this invention
14 a third embodiment of the braider of this invention
20 a fourth embodiment of the braider of this invention
21 a fifth embodiment of the braider of this invention
22 smooth flexible member for holding hair strands in place within the first cavity
23 wavy flexible member for holding hair strands in place within a first cavity
24 smooth flexible member for holding hair strands in place within the second cavity
25 wavy flexible member for holding hair strands in place within a second cavity
26 a sixth embodiment of the braider of this invention
27 a third cavity in a three-cavity braider
28 a seventh embodiment of the braider of this invention

32 an eighth embodiment of the braider of this invention
37 hanger hole
38 a ninth embodiment of the braider of this invention
40 a third cavity in a four-cavity braider
42 a fourth cavity in a four-cavity braider
44 back of a user's head
46 first section of the user's hair
48 second section of the user's hair
50 small sub-section of the first section of the user's hair
52 small sub-section of the second section of the user's hair
54 a herringbone braid
56 twisted sub-section of the first section of the user's hair
61 twisted sub-section of the first section of the user's hair
62 twisted sub-section of the first section of the user's hair
63 twisted sub-section of the second section of user's hair
64 twisted sub-section of the second section of user's hair
66 sub-section of user's hair
68 sub-section of user's hair
70 rope braid formed with the help of the braider of this invention
72 section of user's hair containing sub-sections of section 46 and section 48

DETAILED DESCRIPTION OF THE INVENTION

Various aspects of the present invention will evolve from the following detailed description which should be taken in conjunction with the prior described drawings.

FIG. 1

Figure 5:
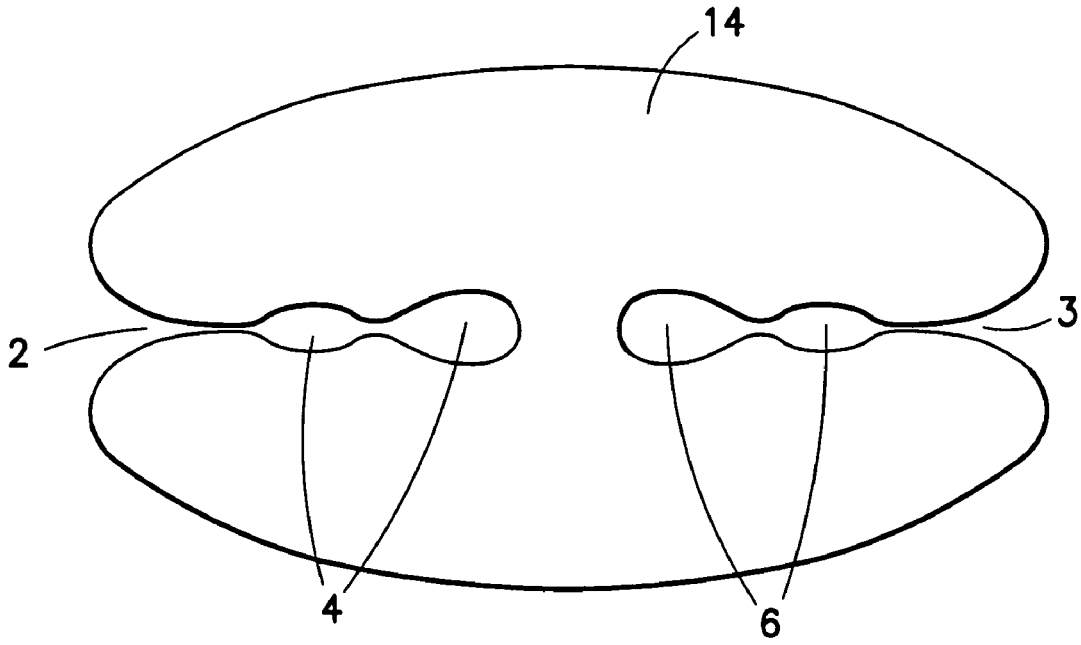
FIG. 5 shows the top elevational view of a third embodiment of the braider of this invention.
Figure 6:
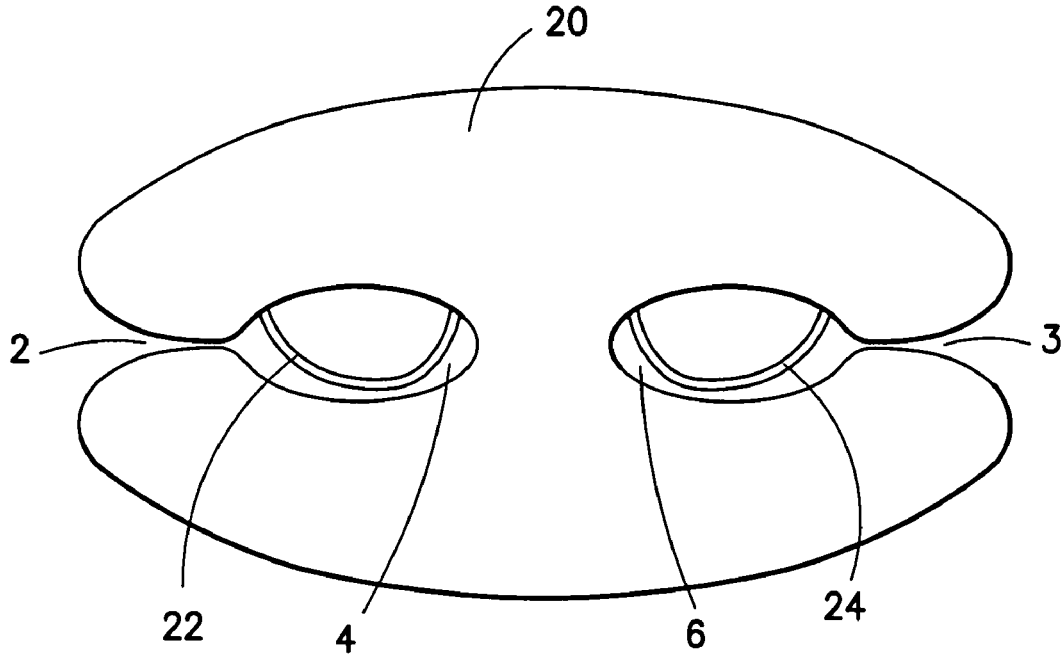
FIG. 6 shows the top elevational view of a fourth embodiment of the braider of this invention.
Figure 7:
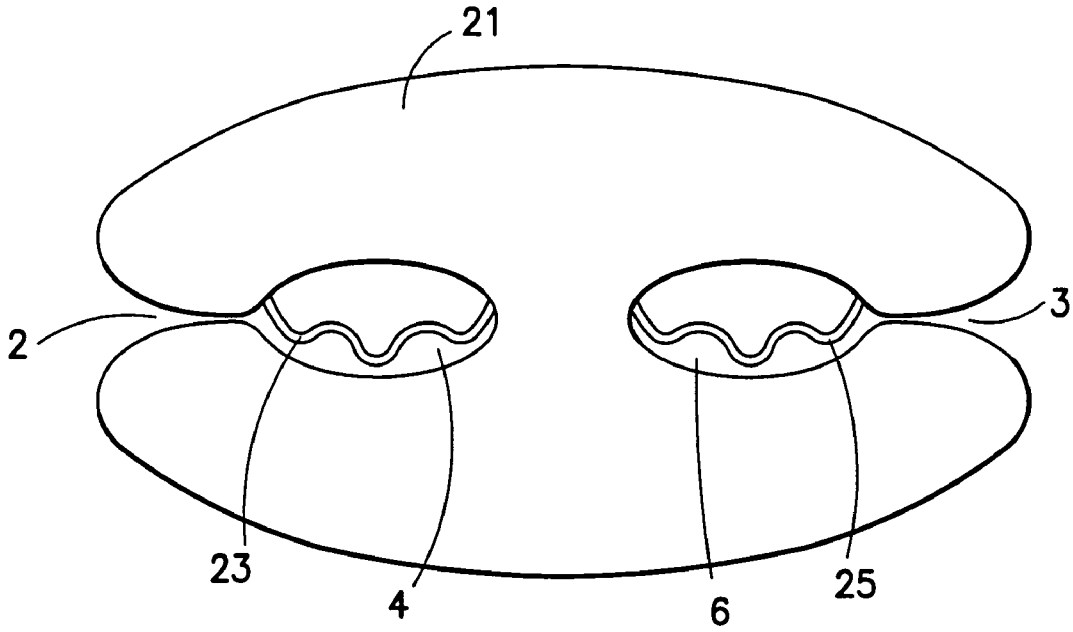
FIG. 7 shows the top elevational view of a fifth embodiment of the braider of this invention.

FIG. 1 shows a top elevational view of the first embodiment of the braider of this invention. Braider 1 of this embodiment is substantially planar though it may be made in a variety of different shapes without detracting from the spirit of this invention. The braider of FIG. 1 is seen to have two cavities 4 and 6 for receiving and holding sections of hair. The size of these cavities is such that the hair to be braided can be held snugly within these cavities so as to prevent the braider from slipping off. At the same time, each cavity should be designed so as to allow for both easy removal from the cavity and easy insertion into the cavity of hair sections. Braider regions forming mouth portion 2 of cavity 4 and mouth portion 3 of cavity 6 are flexible so as to allow hair strands to be easily introduced into and removed from the cavities. Many variations in the shape of the cavities are possible. The cavities may be circular, angular, elongated, or any other shape though in each case a smooth shape is to be preferred over an angular shape in order for the hair sections to beheld snugly within the cavities as well as be able to slide hair strands along the surfaces of the cavities. At least a portion of the edges of the cavities can be made wavy or crimped to better hold sections of hair. Alternatively, as shown in FIGS. 6 and 7, the cavities may be designed to include a resilient member that can be reversibly deformed to better hold different thickness of hair. Another design of this tool, as shown in FIG. 5, would be to subdivide cavities 4 and 6 into a series of cavities each.

FIG. 2

Figure 2:
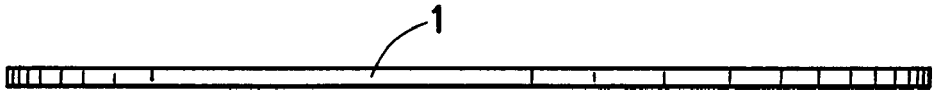
FIG. 2 shows the front elevational view of the braider of this invention. The rear elevational view is a mirror image of this view and is, therefore, not shown.

FIG. 2 shows the front elevational view of the braider of this invention.

FIG. 3

Figure 3:
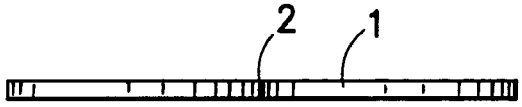
FIG. 3 shows the left-side elevational view of the braider of this invention. The right-side elevational view is a mirror image and is, therefore, not shown.

FIG. 3 shows the left elevational view of the braider of this invention. While the braider has been shown to be substantially planar, many different options are possible for the profile of the braider. For instance, the side profile may be made in an oval shape, resembling the profile of a standard bar of soap. The actual shape of the braider can be varied while still maintaining the spirit of this invention.

FIG. 4

Figure 4:
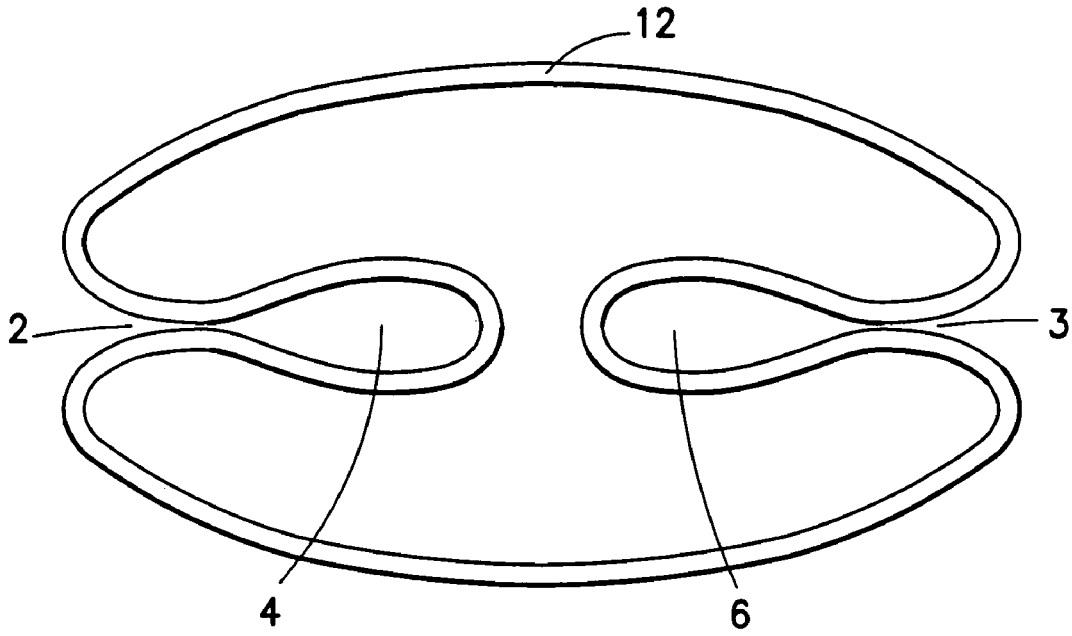
FIG. 4 shows the top elevational view of a second embodiment of the braider of this invention.

FIG. 4 shows braider 12, a second embodiment of the braider of this invention, in which the body of the braider has been reduced to an outline with most of the body portion being hollow. This frame can be made from a tube or wire-like flexible material. It can also be made from a band of flexible material. In fact, a variety of different materials and cross-sections for the frame may be used. The shape of the frame itself may vary. It is, however, important that the material and design of the frame be such as to allow hair sections to be introduced into and removed from cavities 4 and 6 easily.

FIG. 5

FIG. 5 shows the top elevational view of braider 14, a third embodiment of the braider of this invention. As shown in FIG. 5, cavities 4 and 6 each consists of two cavities each to better retain different thicknesses of hair. In fact, each of cavity 4 and cavity 6 may be divided into more than two cavities each. However, it is important that care be taken with a multi-cavity design to avoid compromising the ease of removing sections of hair or of inserting sections of hair into the cavities. In braider 14, the two smaller sub-cavities of cavity 4 and cavity 6 may be made of different sizes. For instance, the front sub-cavity of cavity 4 may be made longer and narrower while the rear sub-cavity of cavity 4 may be made shorter and wider. This will allow for more uses of the braiding tool. For instance, very narrow sections of hair may be held snugly as well as very wide sections. Teeth may also be used within the cavities to further help the cavities grab hair sections. However teeth are likely to interfere with the process of removing sections of hair from the cavities; thus if teeth are used, care should be taken that they have the correct flexibility, size and alignment so as to not hinder the braiding process.

FIGS. 6 and 7

FIG. 6 shows braider 20 which is a fourth embodiment of the braider of this invention. Braider 20 includes flexible elements 22 and 24 in cavities 4 and 6 respectively. These flexible elements help better retain hair within the cavities and make the braider adaptable for thick hair sections as well as thin ones. These flexible members can be made in a variety of shapes, including but not limited to wavy, zigzag, arcuate, smooth, etc. The flexible members may be attached at different points within the cavity without losing their functionality. They may be made of the same material as the rest of the braider. The flexible members 22 and 24 may be a continuation of the body portion of braider 20 and thus made during the same manufacturing step as the rest of the braider. Alternatively, they may be of a different material and attached in a different step than the manufacturing of the remainder of the braider. Members 22 and 24 may be flexible plastic members or metallic members that can be distorted temporarily by the application of force. FIG. 7 shows braider 21 in which the flexible elements 23 and 25 have been made wavy.

FIG. 8

Braider 26 is a sixth embodiment of the braiding tool of this invention. It includes a third cavity 27 that can be used to make chevron braids and other related styles.

FIG. 9

Figure 9:
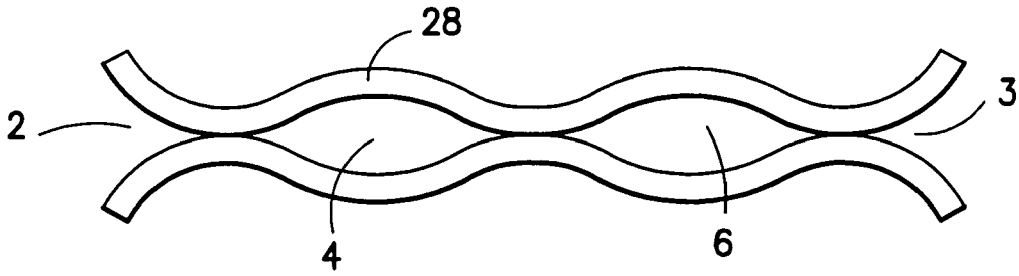
FIG. 9 shows the top elevational view of a seventh embodiment of the braider of this invention.

FIG. 9 shows the top elevational view of braider 28 which is a seventh embodiment of the braider of this invention. In braider 28, the body portion has been substantially reduced. This braider design will be lightweight and also easy to manufacture. However, precisely because of the reduced body portion, this embodiment of the braider may be harder to grasp in the user's hand as compared to some of the other embodiments. Braider 28 may be made by a variety of processes and a variety of materials. For instance, it could be made from two elongated, appropriately shaped members that are joined together at a point intermediate the two cavities of the braider. Braider 28 could also be made via a molding process. Alternatively it may be made from two, flexible metal bands that are joined at a point intermediate the two cavities. These manufacturing suggestions are not intended to be comprehensive; rather they are intended to give the reader an idea of some of the available options.

FIG. 10

Figure 10:
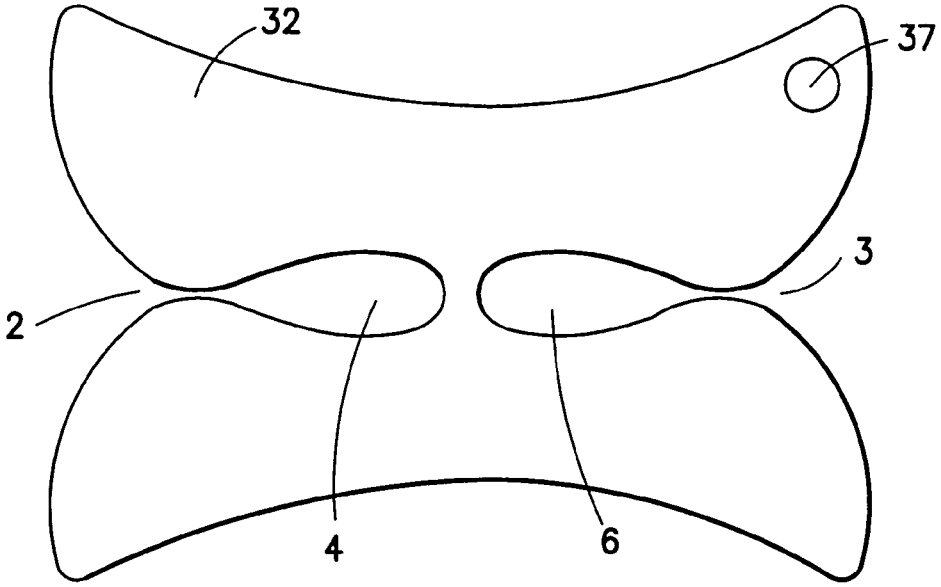
FIG. 10 shows the top elevational view of an eighth embodiment of the braider of this invention.

FIG. 10 show braider 32 which is the eighth embodiment of the braider of this invention. This embodiment is intended to show yet another possible shape for the braider. The braider can also be made circular or semicircular with a concave or convex profile. Braider 32 also shows a hanger hole 37. Hanger hole 37 may be placed at different locations on the body portion of the braider. The presence of a hanger hole directly on the braider will help reduce packaging requirements and allow for easy display and storage.

FIG. 11

Braider 38 is a ninth embodiment of the braider of this invention. Braider 38 can be seen to have two additional cavities 40 and 42. The presence of these cavities allows for a braiding method that is slightly different from the two-cavity braider embodiments. The presence of these extra cavities also allows for additional, more complex braiding styles. However, the presence of extra cavities also increases the complexity of the braiding process thus reducing the ease-of-use and the consumer appeal of the braider.

Figure 12:
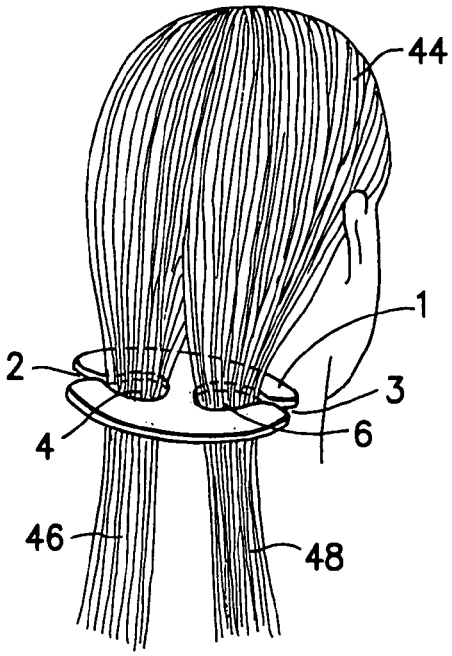
FIGS. 12, 13 and 14 illustrate how the first embodiment of the braider of this invention may be used to create a basic herringbone braid.
Figure 13:
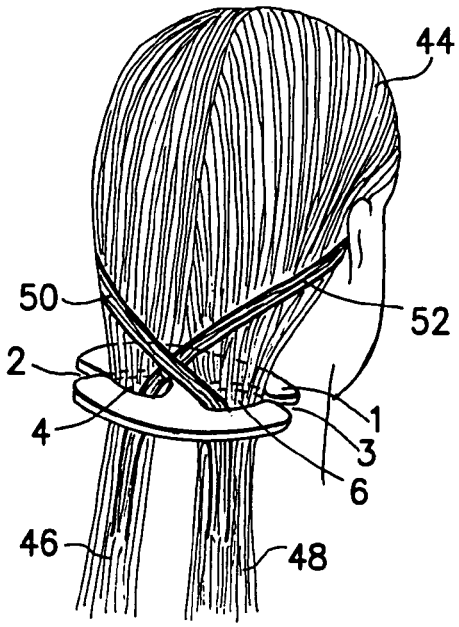
Figure 14:
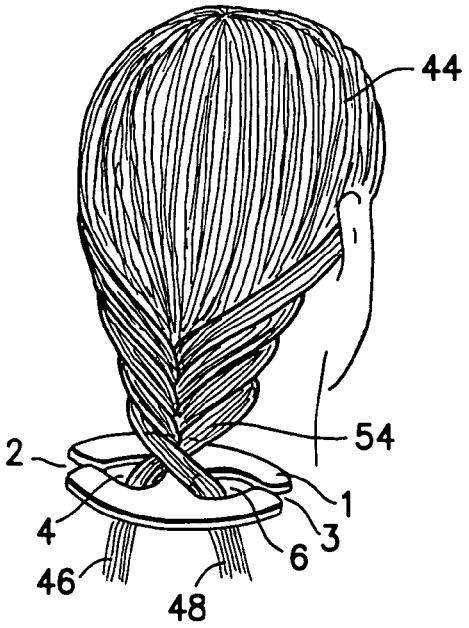

FIGS. 12, 13, and 14

FIGS. 12, 13, and 14 show how the braider of this invention may be used to make a herringbone braid. FIG. 12 shows the first step of the braiding process. Head 44 of the wearer is seen from the back. The wearer's hair is seen divided into a first section 46 and a second section 48. Each section is seen placed within a cavity of braider 1. Section 46 is placed in cavity 4 while section 48 is placed in cavity 6. The hair sections are held snugly but removably within cavities 4 and 6 such that braider 1 will not slip off when released by the wearer. The embodiments of FIGS. 6 and 7 are to be preferred because they can accommodate different thicknesses of hair and fulfill all the requirements of a versatile braiding device.

FIG. 13 shows sub-section 50 of section 46 removed from cavity 4 and transferred into cavity 6. Thus sub-section 50 has now been merged with section 48. Better braiding results will be achieved if sub-section 50 is removed from the outermost region of cavity 4 and introduced into the innermost region of cavity 6. FIG. 13 also shows sub-section 52 removed from the outermost region of cavity 6 and transferred into the innermost region of cavity 4. Sub-section 52 has now been merged with section 46.

FIG. 14 shows herringbone braid 54 that is formed by repeating the steps of FIG. 13 several times. Sub-sections of hair are transferred repeatedly and alternately between cavities 4 and 6. As the braiding progresses, braider 1 is made to slide along sections 46 and 48. Once braiding is complete, the braider is slipped off the wearer's hair and a ponytail holder or a clip or an equivalent device is placed on the braid to keep it from unraveling. Braider 1 may even be allowed to remain in the wearer's hair after the braiding is completed. One of the many advantages of the braider of this invention is that since the braider prevents the braid from unraveling, the braiding process may be interrupted several times and continued after the interruptions without having to start from scratch.

FIG. 15

Figure 15:
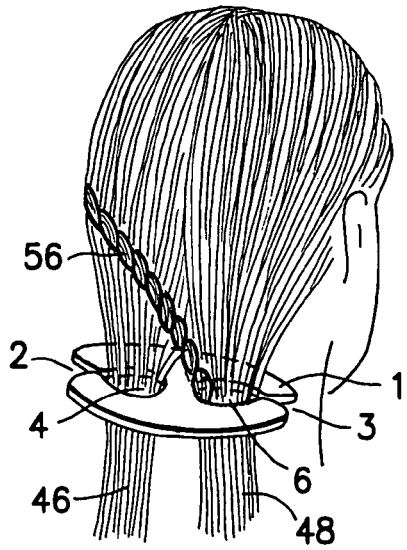
FIG. 15 shows how a diagonal braid may be created with the help of the first embodiment of the braider of this invention.

In FIG. 15, sub-section 56 of hair is first removed from cavity 4. It is then twisted several times before being introduced into cavity 6. The herringbone braid shown in FIG. 14 can be modified so that sub-sections 50 and 52 of FIG. 13 are twisted in the manner of sub-section 56 of FIG. 15 before being transferred to the opposite cavity. This will result in a beautiful new variation of the herringbone braid called the twisted herringbone braid.

An asymmetric diagonal braid can be formed by repeating the process shown in FIG. 15 for several sub-sections of hair. To form such a braid, several sub-sections of hair like sub-section 56 are removed from cavity 4, twisted, and then transferred to cavity 6.

In FIG. 15, if the twisted sub-section of hair 56, instead of being transferred to cavity 6, is instead wrapped snugly around all the hair of the wearer and secured discretely with a pin or an equivalent device, then the result will be an elegant ponytail held by a coil of the user's own hair. Multiple such coils may be wrapped around the ponytail resulting in a beautiful serpentine coil braid.

Figure 16:
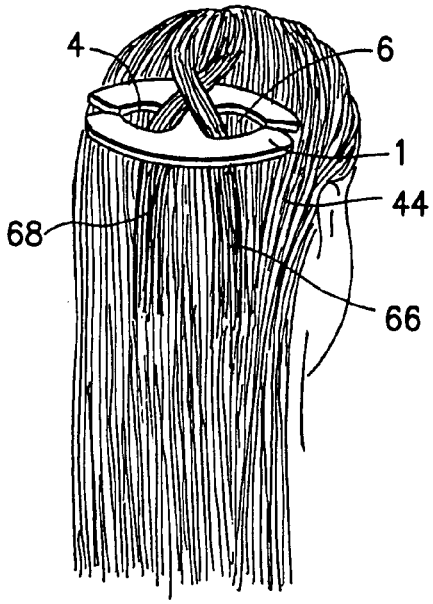
FIGS. 16 and 17 show the basic steps involved in creating a rope braid.
Figure 17:
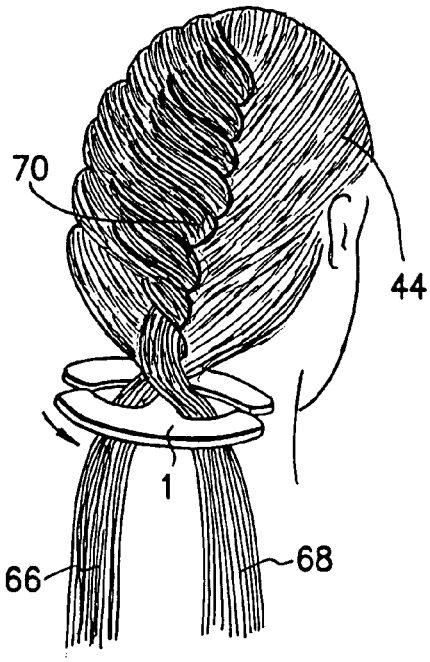

FIGS. 16 and 17

FIGS. 16 and 17 show how the braider of this invention may be used to make a rope braid. First a small sub-section of the hair to be braided is placed in each of the two cavities of the braider. Sub-section 66 is placed in cavity 6 while sub-section 68 is placed in cavity 4. Sub-sections 66 and 68 now form an "x". Another sub-section of hair is now added to sub-section 68 in cavity 6. Likewise, another sub-section of hair is added to sub-section 66 in cavity 4. The tool is rotated one or more times so as to intertwine the sections of hair contained within cavities 4 and 6. This process of adding sub-sections of hair and rotating the tool is repeated as many times as desired. The braider is moved downward along the hair strands during the braiding process. The result is rope braid 70 that is shown in FIG. 17.

FIG. 18

Figure 8:
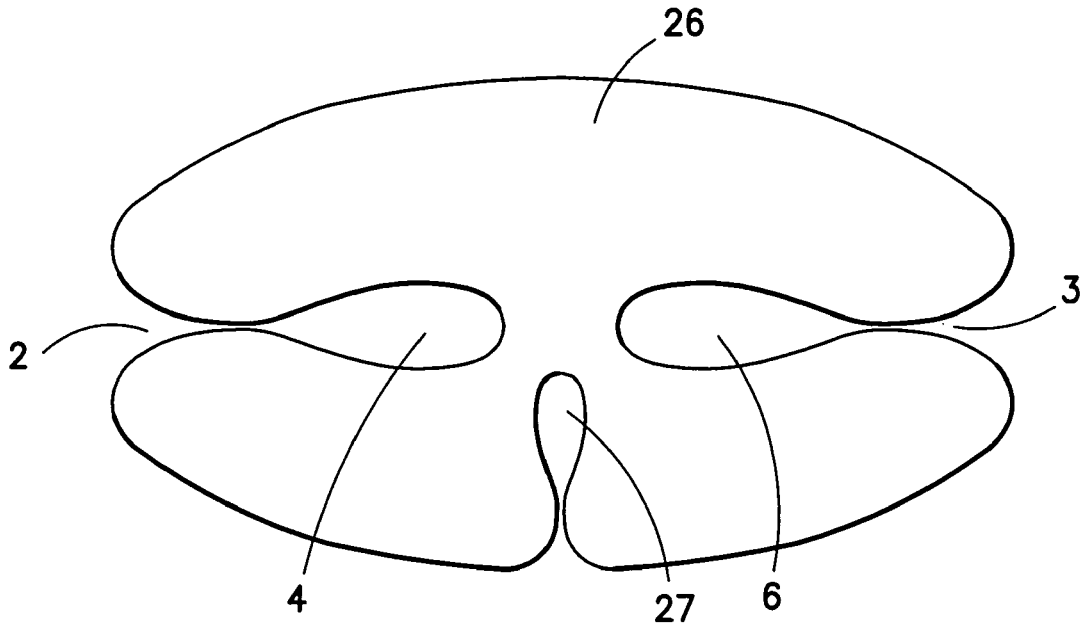
FIG. 8 shows the top elevational view of a sixth embodiment of the braider of this invention.
Figure 18:
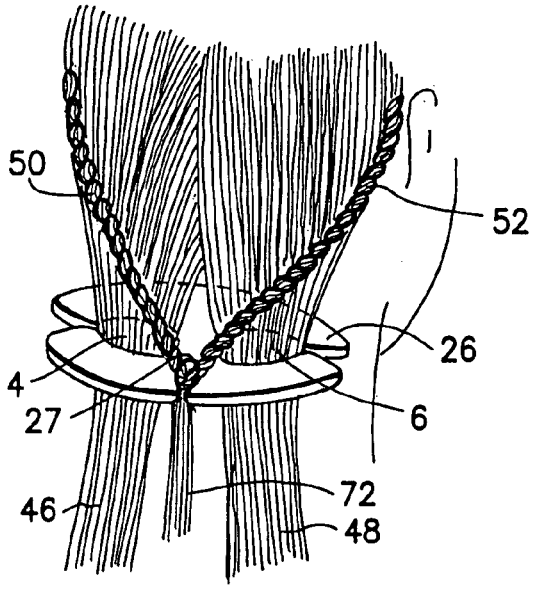
FIG. 18 shows how a chevron braid may be created using the three-cavity or sixth embodiment of the braider of this invention.

FIG. 18 shows braider 26 of FIG. 8 being used to braid hair. Sections 46 and 48 of hair are first placed in cavities 4 and 6 respectively of braider 26. Then sub-sections of hair are removed alternately from sections 46 and 48 and introduced into cavity 27. The sub-sections of hair introduced into cavity 27 form a growing section of hair 72. As the braiding continues, braider 26 is gradually moved down along the user's hair. The result is a chevron braid. Once braider 26 is removed, the chevron braid can be kept from unraveling by using a rubber band or an equivalent device.

FIG. 19

In yet another variation of the step shown in FIG. 15, sub-sections of hair may be removed from a cavity, twisted, and then reintroduced into the same cavity to keep them from untwisting. All of the hair may be thus be divided into sub-sections and twisted. Once all the sub-sections are twisted, the braiding device may be carefully removed and the twisted strands fastened together with a single ponytail elastic. The result will be a beautiful cluster of twisted sub-sections. Alternatively, the twisted sub-sections of hair may be transferred between cavities in a predetermined sequence. This will result in a variation on the twisted herringbone braid.

Aside from the various braids described above, non-braided hairstyles can also be achieved with the braider of this invention. For instance, the braider may be used in the manner of a clip to hold sections of hair. FIG. 16 has already shown how two sub-sections of hair may be threaded through the cavities of the braider. The braider may be held in place even more securely by re-threading the sub-sections of hair through the cavities one-more time. Thus, sub-section 66 may be further rethreaded through cavity 6 from front to back. Likewise, sub-section 68 of hair may be rethreaded through cavity 4.

The order in which hair sections are inserted into cavities and looped over the braider may be varied infinitely. The result of this weaving will be updos in which the braider becomes a part of the hair style. Thus, anyone skilled in the art will see that the braider can not only help make braids, but it can also be more than a tool. It can be used as a decorative hair accessory in its own right.

The braider of this invention can also be used in place of a hair clip. A miniature braider can be made in the shape of a flower. In this use, the braider cavities can be made very small in order to hold very small sections of hair. Small sections of hair may be anchored together by weaving them through the cavities of a braider. Miniature braiders made in many other attractive shapes may be scattered throughout a wearer's hair. Aside from flower designs, a braider may be made in many other styles such as butterflies, animals, etc. It may be encrusted with gemstones. Alternatively, strings of beads or ribbons may be attached to the braider. It may also be used to attach hair extensions to a wearer's hair. The user's hair and hair extensions may be interwoven through a braider by looping them through the cavities of the braider. The braider may be anchored to the wearer's hair by inserting sections of the wearer's hair through the cavities of the braider.

Aside from the different braids and methods of braiding hair shown in the above figures, many others are possible by making minor adjustments to the structure of the braider or the process of braiding. Elements of the various embodiments may be mixed and matched. The method for braiding hair can also be modified without taking away from the spirit of this invention. For instance, selective subsections of hair can be twisted during the braiding process. Using thick sub-sections of hair will result in a braid that will look very different from one made with very thin sub-sections. Likewise, using different sizes of sub-sections of hair in the same braid can result in a pattern that will appear to be complex but be as easy to make as the standard herringbone braid. Using a braider with cavities that are far apart or closer together can result in different looks of braids.

OPERATION OF THE INVENTION

In using braider 1 to make a basic herringbone braid, the wearer first divides the hair to be braided into two approximately equal sections. These sections 46 and 48 can be seen in FIG. 12. Section 46 is inserted into cavity 4 via mouth 2 while section 48 is inserted into cavity 6 via mouth 3. The point of placement of braider 1 on the wearer's hair should be at the point where the braiding of hair is to begin. The plane of braider 1 will be substantially perpendicular to the length of the hair to be braided. The cavities of braider 1 should be of a size and a design so as to hold hair snugly but not too tightly. The braider should sit snugly on the wearer's hair such that it can be slid down the hair easily by the user but will not do so under its own weight. The shape of the cavities and the presence of additional holding mechanisms such as shown in FIGS. 6 and 7 will also help in retaining sections of hair within the cavities. Any holding mechanism employed within the cavities should be such as to also allow for easy removal of sub-sections of hair. Thus teeth present within the cavities may interfere with the process of introduction and removal of hair from within the cavities. If teeth are included within the cavities they should be very small, flexible and/or aligned so as to not resist the addition or removal of sections of hair.

Once braider 1 is placed in the wearer's hair as shown in FIG. 12, a sub-section of hair 50, shown in FIG. 13, is separated from section 46 and removed from cavity 4. This sub-section of hair should ideally be removed from the outermost region of cavity 4. Sub-section of hair 50 is then introduced into cavity 6 so that it crosses over diagonally from section 46 to section 48. Sub-section 50 should ideally be pushed into the innermost region of cavity 6 as shown in FIG. 13.

Next the preceding step is repeated for section 48. A sub-section of hair 52 is separated from section 48 and removed from cavity 6. This sub-section of hair should ideally be removed from the outermost region of cavity 6. A hooked or rat-tailed tool may be employed for separating sub-section 52 of hair. This sub-section of hair is then inserted into cavity 4 so that it crosses over diagonally from section 48 to section 46. Sub-section 52 should ideally be pushed into the innermost region of cavity 4 as shown in FIG. 13.

Subsequently, sub-sections of hair are separated alternately from sections 46 and 48 and transferred to the opposite cavity as described in the preceding paragraphs: first a sub-section is removed from the outer portion of section 46 and transferred to join the innermost region of cavity 6. Then a sub-section of hair is removed from the outermost portion of section 48 and transferred to join the innermost region of cavity 4. As the braiding progresses, braider 1 is gradually moved downward along sections 46 and 48 to make room for the growing braid.

The resulting braid 70 can be seen in FIG. 14. This herringbone braid is very different in appearance from the standard 3-section braid. Once the desired length of hair has been braided, braider 1 may be slipped off the wearer's hair and a ponytail holder or an equivalent holding device may be used to prevent the braid from unraveling. Alternatively, an attractively made braider may be left in the braided hair.

A variation of herringbone braid 54 of FIG. 14 is one in which each sub-section of hair is first twisted several times before being inserted into the opposing cavity. In other words, sub-section 50 would first be separated from section 46, then twisted several times and only then inserted into cavity 6. Likewise, sub-section of hair 52 would first be separated from section 48, twisted several times and then introduced into cavity 4. This process would result in a modified herringbone braid called the twisted herringbone braid.

The braiding method for braider 26 of FIG. 8 is slightly different from the above. The method starts with placing two approximately half-sections of hair in cavities 4 and 6. But the difference is that in the case of braider 26, sub-sections of hair removed from cavities 4 and 6 are placed in cavity 27. This can be seen in FIG. 18. Sub-sections of hair transferred from cavities 4 and 6 to cavity 27 result in a growing section of hair 72. The resulting braid, the chevron braid, looks like a series of "Vs". In this case there is no exchange of sub-sections of hair between cavities 4 and 6.

Figure 11:
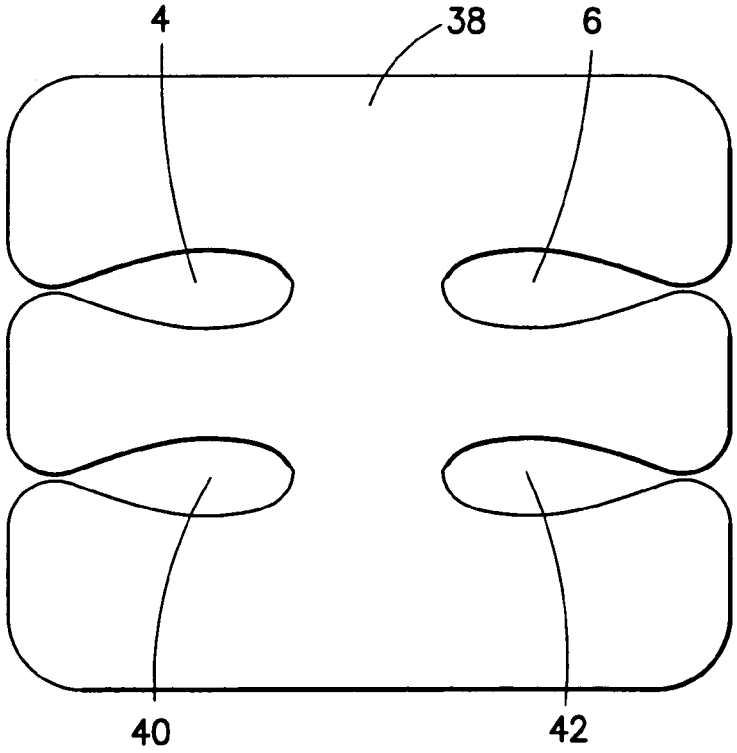
FIG. 11 shows the top elevational view of a ninth embodiment of the braider of this invention.

Braider 38 uses a slightly different method for braiding hair. First the two approximately half sections of hair are placed in cavities 4 and 6. Then a sub-section of hair is removed from cavity 4 and placed in cavity 42 of FIG. 11. Next, a sub-section of hair is removed from cavity 6 and introduced into cavity 40. Sub-sections of hair may be twisted prior to being inserted into the opposite cavity. The method of alternately transferring hair is repeated until a desired length of braid is formed. Braider 38 has the disadvantage that it is more complicated to use since there are multiple cavities; and the more the number of cavities, the harder it is for a novice user to figure out which cavity to use. Thus, the two-cavity braiding tool is superior to a multi-cavity version. However, for a professional user, a multi-cavity tool would be very useful because it would allow for more complex patterns of braids.

Aside from the basic herringbone braid and the twisted herringbone braid, many other varieties of braids may be easily created with the two-cavity embodiment. One such braid is the diagonal braid. First, the hair to be braided is divided into two sections. The sections may be of equal thickness or one section may be much larger than the other. In an extreme case, the entire section of hair can be placed in one cavity. In FIG. 15, the hair is shown divided into two approximately equal sections. Sub-section of hair 56 is then separated from section 46. It is twisted several times forming a rope. This rope is then inserted into cavity 6. If a second sub-section of hair is then removed from section 46, twisted and inserted into cavity 6 and a third sub-section of hair is then removed from section 46 and the process is repeated once again then the result is an asymmetrical braid with twisted ropes going diagonally across the wearer's hair. As many twisted sub-sections as desired may be created. Once the braiding is done, braider 1 is slipped off the user's hair and the resulting braid secured with an elastic circle or an equivalent device.

Yet another braid that can be made with the braider is the coil braid. This method can start off with a twisted sub-section such as sub-section 56 shown in FIG. 15. However, in the next step, instead of being transferred to cavity 6 as shown in FIG. 15, it is crossed over diagonally towards section 48, looped behind section 48, and then reinserted into cavity 4. Prior to being reinserted into cavity 4, twisted sub-section 56 may be looped around the entire hair more than once. This process may be repeated for several sub-sections of hair. The result of this braiding method is a beautiful coil braid. The braid may be secured with a discretely placed pin or a circle of elastic that securely grabs the ends of all the twisted coils of hair.

Figure 19:
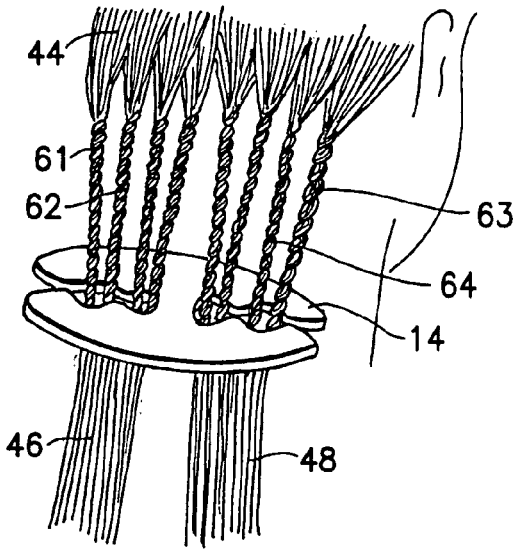
FIG. 19 shows how the braider of this invention may be used to create a multi-twist hair style.

FIG. 19 shows a multi-rope hairstyle. In achieving this style, the braider acts as a holding tool to prevent twisted sub-sections of hair from unraveling. First, the hair to be braided is divided into two sections. The sections may be of equal thicknesses or one section could be much larger than the other. In an extreme case, the entire section of hair can be placed in one cavity. In FIG. 19, the hair is shown divided into two approximately equal sections. Section 48 is introduced into cavity 6 while section 46 is introduced into cavity 4. Alternatively, section 46 may be allowed to remain outside of the braider. In making this multi-rope braid, the braider is placed at a point where the braiding is to end. A small sub-section of hair 61 is separated from section 46. Sub-section 61 is twisted several times. It is then introduced into cavity 4 of braider 14 to prevent it from unraveling. A second sub-section 62 is then separated from section 46. It is twisted several times into a rope. Twisted sub-section 62 is then inserted into cavity 4. For this braiding style, a narrow cavity or a flexible holding element will help hold small sub-sections securely. This process is repeated several times until all of section 46 has been introduced into cavity 4 in the form of twisted ropes. At this point, all of section 46 is in cavity 4. Section 48 is now entirely removed from cavity 6. Sub-section of hair 63 is separated from section 48, twisted, and inserted into cavity 6. This process is repeated so that, as in the case of section 46, all of section 48 is introduced into cavity 6 in the form of twisted ropes. At this point, braider 14 may be slipped off the hair carefully so as to not unravel the twisted ropes. A circle of elastic or equivalent device should be used to anchor the resulting hairstyle. A further modification of this hair style would be to first create a number of twisted sub-sections as just described and then to transfer these sub-sections between the cavities in a random or sequential manner.

FIGS. 16 and 17 show how the braider may be used to make a rope braid. In this braiding style, two small sub-sections, 66 and 68, of the hair to be braided are placed in the two cavities of the braider. Sub-section 66 is placed in cavity 6 and sub-section 68 is placed in cavity 4. As can be seen in FIG. 16, sub-section 68 and sub-section 66 cross over each other to form an "x". Another small sub-section of hair is now added to sub-section 68. Likewise, a sub-section of hair is added to sub-section 66. The tool is then rotated one or more times. This process of adding sub-sections and rotating the tool is repeated as many times as desired. The result is braid 70 that is shown in FIG. 17.

This braid as well as many of the other braids previously described in this application may be started high up on the wearer's head or they may be started at the nape of the neck or at any point along the length of the wearer's hair. When a basic herringbone braid is started high up on the wearer's head, it is called a French herringbone braid.

A braider may also be used to create a non-braid hairstyle. An attractively manufactured braider may become a part of a hairstyle. To achieve this hair style, sections of a wearer's hair may be woven through the cavities of the braider several times. For example, a section of hair can be first inserted into cavity 6, then looped diagonally over the braider, and then reinserted into cavity 4. Depending on the length of the hair-strand, it may be looped again over the braider and inserted into either cavity 4 or cavity 6. Several sections of hair may be woven through the braider in this fashion.

Likewise, a non-braid hairstyle may be created with the help of a miniature braider made in the shape of a flower. In this use, the braider cavities can be reduced in size to hold very small sections of hair. Small sections of hair may be anchored together by weaving them through the cavities of the braider. Miniature braiders made in attractive shapes may be scattered throughout a wearer's hair. Aside from flower designs, a braider may be made in many other styles such as butterflies, animals, leaves, moon, sun, etc. It may also be encrusted with gemstones. Alternatively, strings of beads or ribbons may be attached to the braider. An embodiment of the braider may also be used to attach hair extensions to a wearer's hair. The user's hair and hair extensions may be inter-woven through a braider. Alternatively, hair extensions may be attached permanently to a braider. The braider may be then be anchored to the wearer's hair by inserting sections of the wearer's hair through the cavities of the braider.

While certain novel features and uses of this invention have been shown and described, it is not intended to be limited to the details above, since it will be understood that various omissions, modifications, substitutions and changes in the forms and details of the device illustrated and its operations can be made by those skilled in the art without departing in any way from the spirit of the present invention.

CONCLUSION, RAMIFICATIONS, AND SCOPE OF INVENTION

Thus the reader will see that the braider of this invention provides a simple tool for making a wide variety of very attractive braids and other hairstyles. This tool is an improvement on existing prior art devices because it is much simpler in construction and use. Because of its simple design, the braider of this invention is very easy and inexpensive to manufacture. The low manufacturing costs will eventually translate to better value for the user.

The simple design of the braider has an additional advantage: unlike prior art tools, it does not intimidate the user with its complex appearance. Most prior art tools had complicated user instructions. A novice user felt defeated even before attempting to use those prior art devices. In contrast, the very simple design of the braider of this invention will appeal to users.

Despite its simplicity, however, the braider of this invention is very versatile and allows a user to achieve a wide variety of hair styles, both braided and non-braided. Most of the prior art devices were intended for very specific one or two braids. In contrast, the braider of this invention can help create a number of very different braids: the herringbone braid, the diagonal braid, the coil braid, the rope braid, the multi-twisted braid, the chevron braid and many others. Additionally, the braider can help create non-braid styles as well. For instance, the braider can help create an updo by acting as a hair clip into which sections of hair may be anchored. The braider can be made in beautiful colors and shapes so that miniature versions can be used as hair clips throughout a wearer's hair.

Even though the braider of this invention is very versatile and can create many different hair styles, it is very easy to use. Most of the prior art devices had multiple cavities for receiving sections of hair. That made the braiding process very complicated because the user had to keep track of which cavity to use for which hair section. This complication was even more pronounced for a user attempting to braid her own hair at the back of her head where she couldn't see the braider.

In contrast, the preferred embodiment of the braider of this invention has just two cavities. Hair sections removed from one cavity have only one other cavity to go to. Thus the braiding process is much simplified. A user no longer has to keep track of which cavity to put a hair section into. The preferred positioning of the cavities opposite each other further helps the user avoid any confusion about which cavity the hair sections are supposed to be inserted into.

Even though the device described by Sloan in U.S. Pat. No. 5,819,761 also has two cavities, the design of Sloan's device makes it unsuitable for many uses. Sloan describes a hair braiding device that consists of a flat elongate body having at least one opposing pair of slotted openings with the openings being lined with a resilient material that permits hair strands to be introduced thereinto and that allows the device to be rotated to create a rope braid. The braiding device by Sloan requires multiple manufacturing steps. It is hard to manufacture because it includes a lining attached on the inside of each of the slots. Additionally, even though Sloan's device has two openings, those openings are designed especially to prevent hair strands from escaping from the slots. Sloan's device requires an opposing yieldable lining that will grab on to hair strands when Sloan's device is being rotated. In fact, Sloan's device has been especially designed with rotation in mind. It requires that hair strands not escape from the openings during rotation. The use of fillable lining in Sloan's device is, in fact, intended to prevent hair strands from being easily removed. This makes Sloan's device less than ideal for braids such as the herringbone that require that sections of hair be removed often from the openings during the braiding process. Thus, Sloan's device has several disadvantages as compared to the braider of this invention.

From the preceding discussion, the reader will see that the braider of this invention has many advantages over prior art devices including those of ease of manufacturing, ease of use, extreme versatility, compact structure, and aesthetic appeal.

It is to be realized that the optimum dimensional relationships for the parts of the invention, to include variations in size, materials, function, and manner of operation, assembly and use, are deemed readily apparent and obvious to one skilled in the art, and all equivalent relationships to those illustrated in the drawings and described in the specification are intended to be encompassed by the present invention. While this description is directed to particular embodiments, it is understood that those skilled in the art may conceive modifications and/or variations to the specific embodiments shown and described herein. Any such modifications or variations which fall within the purview of this description are intended to be included as well. For instance, the two cavities of the braider do not need to be placed opposite to each other but may be more proximate. The braider may be made in the form of a trident with two parallel cavities. The body portion of the tool may have a wide variety of different shapes. The cavities themselves may differ in their size, shape and hair retention mechanism. The material of construction of the tool may vary from polymers to wood to cardboard to metal to any of a variety of suitable materials. Thus even though the description above contains many specifics, these should not be construed as limitations on the scope of the invention.

I claim:

1. A method for braiding hair with a hair braiding device, the braiding device including:

a body provided with a plurality of looped and spaced apart braiding regions, each of the plurality of looped braiding regions being provided with a mouth open outwardly, and a cavity located adjacent to and inwardly from the mouth, said method comprising the steps of:

(a) parting hair to be braided into a plurality of braiding strands;

(b) selectively stressing the mouths of the plurality of braiding regions, thereby sequentially inserting each of the plurality of hair strands into a respective one of the cavities of the plurality of hair braiding regions through the stressed mouth;

(c) displacing the inserted hair strands within each of the cavities of the plurality of hair braiding regions upon releasing a respective one of the mouths, thereby forming a plurality of hair sub-segments within the each hair braiding region; and (d) selectively stressing and releasing the mouths of the plurality of hair braiding regions, thereby repeatedly removing and inserting the plurality of hair sub-segments from and into the cavities of the plurality of hair braiding regions so as to create a hair style.

2. The method of claim 1, wherein the plurality of hair braiding regions correspond to a respective one of the variety of hair styles selected from a herringbone braid, diagonal braid, coil braid, rope braid, multi-twisted braid, and chevron braid.

3. The method of claim 1, wherein the plurality of hair braiding regions includes first, second and third hair braiding regions, the step of displacing the inserted hair strands further including transferring a first hair sub-segment from the first hair braiding region into the third hair braiding region, transferring a second hair sub-segment from the second hair braiding region into the third hair braiding region, and repeating the (c') and (c") sub-steps alternately so as to create chevron braid.

4. The method of claim 1, wherein the plurality of hair braiding regions includes first, second, third and fourth hair braiding regions, the step the step of displacing the inserted hair strands further including transferring a first hair sub-segment from the first hair braiding region into the third hair braiding region, transferring a second hair sub-segment from the second hair braiding region into the fourth hair braiding region, and repeating the (c') and (c") sub-steps alternately so as to create a herringbone braid.

5. A method of styling hair with a braid device that has a first cavity and a second cavity, said method including the steps of:

selecting a first hair segment located nearest the first cavity and applying an external force to the braiding device, hereby inserting the first hair segment into the second cavity, picking a second hair segment located nearest the second cavity and inserting said second hair segment into the first cavity upon applying the external force to the braid device;

dividing the first and second hair segments in each of the first and second cavities so as to form multiple hair sub-segments upon removing the external force, alternating the multiple hair sub-segments between the first and second cavities; thereby forming an "x" hair style.

* * * * *